US011253422B1

(12) United States Patent
Johnson

(10) Patent No.: US 11,253,422 B1
(45) Date of Patent: Feb. 22, 2022

(54) ADJUSTABLE PEANUT MASSAGE TOOL

(71) Applicant: Ronald B. Johnson, Honokaa, HI (US)

(72) Inventor: Ronald B. Johnson, Honokaa, HI (US)

( * ) Notice: Subject to any disclaimer, the term of this patent is extended or adjusted under 35 U.S.C. 154(b) by 216 days.

(21) Appl. No.: 16/535,627

(22) Filed: Aug. 8, 2019

(51) Int. Cl.
*A61H 15/00* (2006.01)

(52) U.S. Cl.
CPC ... *A61H 15/0092* (2013.01); *A61H 2015/005* (2013.01); *A61H 2201/169* (2013.01)

(58) Field of Classification Search
CPC ..... A61H 15/0092; A61H 2015/0007; A61H 2015/005; A61H 2015/0021; A61H 2015/0035; A61H 2201/169; A63B 22/20; A63B 22/203
See application file for complete search history.

(56) References Cited

U.S. PATENT DOCUMENTS

| | | | | |
|---|---|---|---|---|
| 655,490 | A | 8/1900 | Hollem | 601/135 |
| 1,726,560 | A | 9/1929 | Hassler | 601/136 |
| 1,811,764 | A | 6/1931 | Sherwood | |
| 2,273,710 | A | 2/1942 | Klaes | 601/119 |
| 2,286,324 | A | 6/1942 | Wentz | |
| 4,210,135 | A | 7/1980 | Deuser | |
| D256,841 | S | 9/1980 | Corbett et al. | |
| 4,345,387 | A | 8/1982 | Daswick | 36/43 |
| 4,378,007 | A | 3/1983 | Kachadourian | |
| D285,117 | S | 8/1986 | Snyder | |
| 4,846,159 | A | 7/1989 | Anzai | |
| 4,907,355 | A | 3/1990 | Allen et al. | 36/131 |
| 4,945,900 | A | 8/1990 | Masuda | |
| 5,123,406 | A | 6/1992 | Masuda | |
| 5,143,056 | A | 9/1992 | Yih-Jong | |
| D345,610 | S | 3/1994 | Shih | |
| D357,952 | S | 5/1995 | Chen | |

(Continued)

OTHER PUBLICATIONS

Muscleroll—Biowellnesssolutions.com—2008.
Power Systems 2009 Product Catalog—p. 73.

*Primary Examiner* — Colin W Stuart
*Assistant Examiner* — Douglas Y Sul
(74) *Attorney, Agent, or Firm* — Booth Udall Fuller, PLC; Kenneth C. Booth

(57) ABSTRACT

A massage tool can include an axle including a root outer diameter, a center stop protrusion, end stop protrusions located at opposing ends of the axle, and at least one set of positioning protrusions located between the center stop protrusion and at least one of the end stop protrusions. An inner positioning protrusion of the at least one set of positioning protrusions is located axially closer to the center stop protrusion than an outer positioning protrusion of the at least one set of positioning protrusions. The outer and inner positioning protrusions each protrude from the root outer diameter of the axle a distance that is less than a distance that the center stop protrusion and the end stop protrusions protrude from the root outer diameter of the axle. Two massage elements each contain a center bore having a bore diameter substantially equal to the root outer diameter of the axle. A length of the center bore of each massage ball is substantially equal to an axial distance between the center stop protrusion and the outer positioning protrusion, and substantially equal to an axial distance between the inner positioning protrusion and a nearest one of the end stop protrusions.

20 Claims, 9 Drawing Sheets

(56) References Cited

U.S. PATENT DOCUMENTS

| | | | | |
|---|---|---|---|---|
| 5,735,804 | A | 4/1998 | Chan | 601/136 |
| 5,824,013 | A | 10/1998 | Allen | 606/240 |
| 5,947,666 | A | 9/1999 | Huang | |
| 6,375,601 | B1 | 4/2002 | Johnson | |
| D471,636 | S | 3/2003 | Yu | |
| 6,764,456 | B1 | 7/2004 | Doherty | 601/121 |
| 7,007,978 | B1 | 3/2006 | Purdom | |
| 7,108,646 | B1 | 9/2006 | Quick | 482/148 |
| 7,285,080 | B1 * | 10/2007 | Chiu | A63B 21/0004 482/142 |
| 7,918,774 | B2 | 4/2011 | Dye | 482/132 |
| 8,584,299 | B2 | 11/2013 | Chan | |
| 10,821,328 | B2 * | 11/2020 | Huang | A61H 15/0092 |
| 2002/0103415 | A1 | 8/2002 | Manska | |
| 2005/0033205 | A1 | 2/2005 | Komkin | |
| 2005/0049532 | A1 | 3/2005 | Lee | |
| 2005/0131320 | A1 | 6/2005 | Lee | 601/119 |
| 2006/0089578 | A1 * | 4/2006 | Hsu | A61H 15/00 601/118 |
| 2007/0072952 | A1 | 3/2007 | Kusakawa et al. | 521/134 |
| 2007/0129654 | A1 | 6/2007 | Anderson, Jr. | 601/119 |
| 2008/0090707 | A1 | 4/2008 | Dye | 482/132 |
| 2008/0103421 | A1 | 5/2008 | Nicholson | |
| 2009/0112137 | A1 | 4/2009 | Lamore | |
| 2010/0049106 | A1 | 2/2010 | Gueret | |
| 2011/0245741 | A1 | 10/2011 | L'Homme | |
| 2011/0257569 | A1 * | 10/2011 | Robins | A61H 15/00 601/137 |
| 2011/0313333 | A1 | 12/2011 | Nicholson | |
| 2012/0065557 | A1 | 3/2012 | Phillips | 601/99 |
| 2013/0190664 | A1 * | 7/2013 | Johnson | A61H 15/0092 601/129 |
| 2014/0114221 | A1 * | 4/2014 | Indermill | A61H 15/0092 601/120 |
| 2015/0245977 | A1 * | 9/2015 | Sungarian | A61H 15/00 601/118 |
| 2020/0093683 | A1 * | 3/2020 | Raines | A61H 15/0092 |

* cited by examiner

ADJUSTABLE PEANUT MASSAGE TOOL

TECHNICAL FIELD

This disclosure relates to a massage tool and a method for making and using the same.

BACKGROUND

Massage tools are common implements utilized to facilitate and assist massaging. Peanut shaped massage tools are typically used to simultaneously massage muscles on both sides of a spine. However, due to variations in the widths of vertebrae between different people and also between different locations of the spine for any given person, there isn't a single most optimal width for the spacing between the two lobes of a peanut massager.

To account for the size variance of different people, attempts have been made to produce peanut massage tools that can adjust the spacing between the lobes. However, the mechanisms provided for lobe adjustment have been cumbersome and ineffective. There is a need for an adjustable peanut massage tool that affords securely adjustable positioning of the peanut lobes, reduces part count, offers simpler and more effective operation and higher durability, while reducing cost associated with the production and assembly of the tool.

SUMMARY

Accordingly, in an aspect, a massage tool can comprise two elastic massage balls, wherein each of the two elastic massage balls may include a center bore having a fixed center diameter with a bore length. The center diameters of the center bores and the bore lengths of each massage ball may be substantially equal in size to each other. The massage tool may further comprise a rigid axle including a root outer diameter, wherein the root outer diameter may be substantially equal in size to the fixed-diameters of the center bores of each of the two elastic massage balls. The rigid axle may further include an annular center stop located proximate a center of the rigid axle and having an outer diameter larger than the root diameter of the rigid axle. In addition, the rigid axle may include annular end stops on opposing ends of the rigid axle, wherein outer diameters of each of the annular end stops may each be larger than the root diameter of the rigid axle. The rigid axle may also include two sets of adjustment ridges. Each set of adjustment ridges may comprise an inner adjustment ridge and an outer adjustment ridge, wherein a first set of the two sets of adjustment ridges may be located along the rigid axle between the annular center stop and a first annular end stop, and a second set of the two sets of adjustment ridges may be located along the rigid axle between the annular center stop and a second annular end stop on an opposite end of the rigid axle from the first annular end stop. All the inner and outer adjustment ridges may have outer diameters larger than the root diameter, but smaller than outer diameters of the annular center stop and the first and second annular end stops. Moreover, the inner and outer adjustment ridges may be positioned along the rigid axle so that an axial distance between the annular center stop and either of the outer adjustment ridges is substantially equal to the bore length of each elastic massage ball, and the axial distance between either inner adjustment ridge and a nearest of the first or second annular end stop is substantially equal to an axial distance between the annular center stop and either of the outer adjustment ridges.

Particular aspects of the massage tool may comprise a rigid axle being of one-piece construction. Each of the two elastic massage balls may include a plurality of elastic protrusions. The two elastic massage balls are formed of material selected from the group consisting of rubber, thermoplastic elastomers, thermoplastic polyurethane, and high density foam. The rigid axle may further comprise two additional sets of inner and outer adjustment ridges, wherein a third set of the two additional sets of adjustment ridges may be located along the rigid axle between the annular center stop and the first annular end stop, and fourth set of the two additional sets of adjustment ridges may be located along the rigid axle between the annular center stop and the second annular end stop. Furthermore, an axial distance between the inner and outer adjustment ridges of each of the two additional sets of adjustment ridges may be substantially equal to the bore lengths of the fixed-diameter center bores of each of the two elastic massage balls. The annular center stop of the rigid axle may include at least one indention, wherein the indention may correspond to a balance point of the adjustable massage tool. The annular center stop may further include a plurality of indentions, wherein each indention of the plurality of indentions may correspond to a balance point of the adjustable massage tool depending on the adjusted placement of the two elastic massage balls along the rigid axle.

In another aspect, a massage tool may comprise an axle. The axle may include a root outer diameter, a center stop protrusion, end stop protrusions located at opposing ends of the axle, and at least one set of positioning protrusions located between the center stop protrusion and at least one of the end stop protrusions. In addition, an inner positioning protrusion of the at least one set of positioning protrusions may be located axially closer to the center stop protrusion than an outer positioning protrusion of the at least one set of positioning protrusions. The outer and inner positioning protrusions may each protrude from the root outer diameter of the axle a distance that is less than a distance that the center stop protrusion and the end stop protrusions protrude from the root outer diameter of the axle.

Particular aspects of the massage tool may comprise features wherein the two massage balls are each made of an elastic material. Moreover, the axle may be rigid and may be of one-piece construction. The center stop protrusion may include at least one indention located at a balance point of the massage tool. Additionally, the center stop protrusion may include a plurality of indentions correspondingly located at balance points of the tool associatively depending on the location of the massage balls along the axle and the relative mass of the massage balls. The center stop protrusion and the end stop protrusions may be annular protrusion features and the inner and outer positioning protrusions may be annular ridges.

In an aspect, a method for adjustably securing massage balls to a peanut massager may comprise providing a peanut massager. The peanut massager may include an axle including a root outer diameter, a center stop protrusion, end stop protrusions located at opposing ends of the axle, and at least one set of positioning protrusions located between the center stop protrusion and at least one of the end stop protrusions. Moreover, an inner positioning protrusion of the at least one set of positioning protrusions may be located axially closer to the center stop protrusion than an outer positioning protrusion of the at least one set of positioning protrusions.

Furthermore, the outer and inner positioning protrusions may each protrude from the root outer diameter of the axle a distance that is less than a distance that the center stop protrusion and the end stop protrusions may protrude from the root outer diameter of the axle. The peanut massager may additionally include two massage elements, wherein each massage element may contain a center bore having a bore diameter substantially equal to the root outer diameter of the axle. A length of the center bore of each massage ball may be substantially equal to an axial distance between the center stop protrusion and the outer positioning protrusion, and may also be substantially equal to an axial distance between the inner positioning protrusion and a nearest one of the end stop protrusions. The method may further include maneuvering the two massage elements so that the center bore of each massage element passes over at least one of the end stop protrusions and so that the center bore of at least one of the two massage elements additionally passes over at least one of the positioning protrusions of the axle, thereby allowing the massage elements to be adjustably yet securely located at a designated position along the axle.

Particular aspects of the method for adjustably securing massage balls to a peanut massager may comprise the center bore of at least one of the two massage elements passes over at least two of the adjustment protrusions. Maneuvering the two massage elements may further comprise maneuvering at least a first of the two massage elements so that its center bore passes over a first end stop protrusion of the axle, and maneuvering at least a second of the two massage elements so that its center bore passes over the other end stop protrusion, so that the massage balls are located on each side of the center stop protrusion. Each of the massage elements may be maneuvered so their center bores both pass over a first of the end stop protrusions. One of the two massage elements may be further maneuvered so that its center bore additionally passes over the center stop protrusion, so that the massage elements are located on opposing sides of the center stop protrusion. The axle of the peanut massager may further include at least one additional set of positioning protrusions located on either side of the center stop protrusion. The center bore of each of the massage elements may also pass over at least one additional positioning protrusion of the at least one additional set of positioning protrusions.

BRIEF DESCRIPTION OF THE DRAWINGS

The invention will hereinafter be described in conjunction with the appended drawings, where like designations denote like elements, and.

DETAILED DESCRIPTION

Figure 1A:
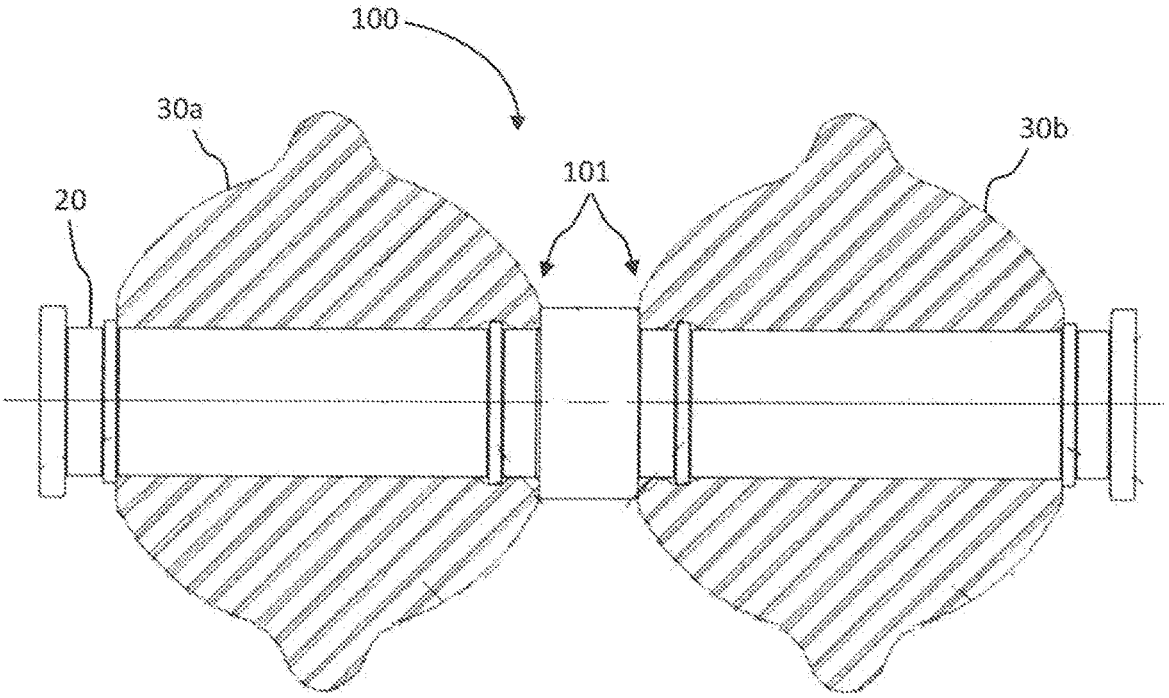
FIG. 1A depicts a side cross-section view of an embodiment of a peanut massage tool having two elastic massage balls maneuvered so as to be securely affixed in a first narrow configuration.

This disclosure, its aspects and implementations, are not limited to the specific material types, or other system component examples, or methods disclosed herein. Many additional components, manufacturing and assembly procedures known in the art consistent with massage tool manufacture are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

While this disclosure includes a number of embodiments in many different forms, there is shown in the drawings and will herein be described in detail, particular embodiments with the understanding that the present disclosure is to be considered as an exemplification of the principles of the disclosed methods and systems, and is not intended to limit the broad aspect of the disclosed concepts to the embodiments illustrated.

Figure 1B:
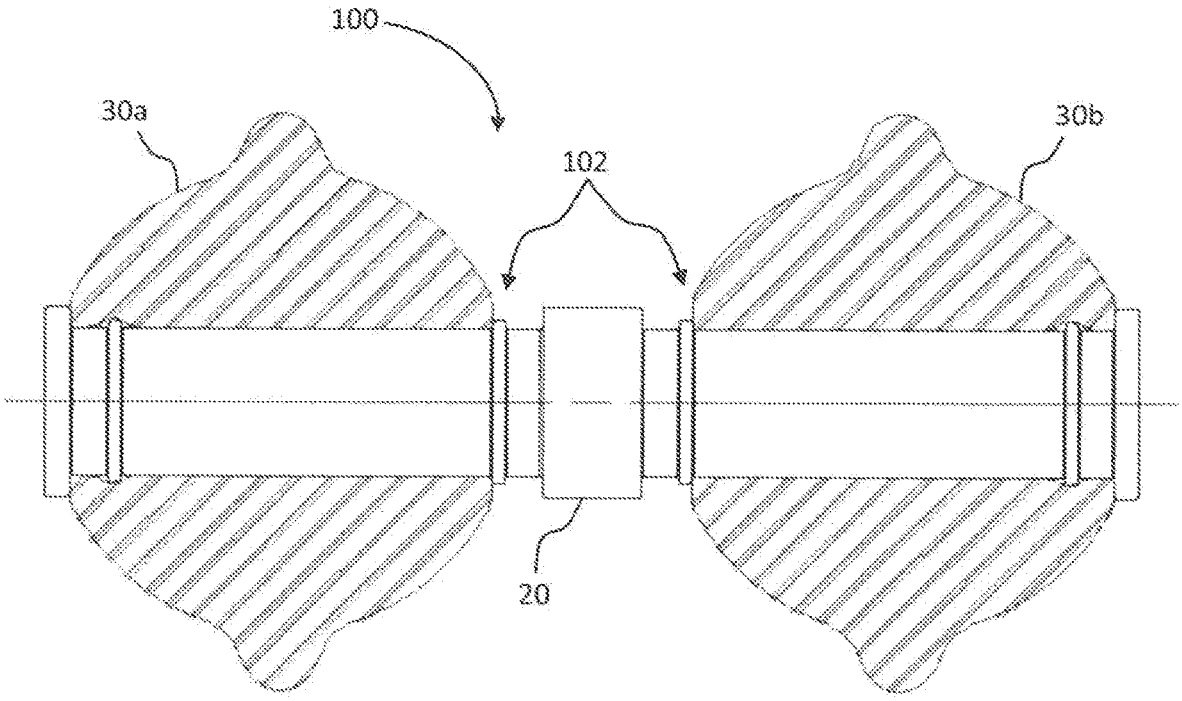
FIG. 1B depicts a side cross-section view of the embodiment of the peanut massage tool of FIG. 1A, wherein the two elastic massage balls have been maneuvered so as to be securely affixed in a second spread apart configuration.

As noted above, there is a need for an improved peanut massage tool. With reference to the drawings, FIG. 1A depicts a side cross-section view of an embodiment of a peanut massage tool 100 having two elastic massage balls 30*a* and 30*b* maneuvered so as to be securely affixed to a rigid axle 20, in a first narrow configuration 101. Embodiments of a peanut massage tool 100 may be adjustable, wherein the massage balls 30*a* and 30*b* may be securely affixed to different locations along the rigid axle 20. Accordingly, FIG. 1B depicts a side cross-section view of the embodiment of the peanut massage tool 100 of FIG. 1A, wherein the two elastic massage balls 30*a* and 30*b* have been maneuvered so as to be securely affixed in a second spread apart configuration 102. Those of ordinary skill in the art will appreciate that various configurations of an embodiment of an adjustable peanut massage tool 100 may be obtained. For instance, in another configuration, the elastic massage ball 30*a* may be securely affixed to the rigid axle 20 so that it resides in a narrow position, while the elastic massage ball 30*b* may be securely affixed to the rigid axle 20 so that it resides in a spread apart position. Moreover the position of the massage balls may be reversed, so that the elastic message ball 30*a* may be securely affixed to the rigid axle 20 so that it resides in a narrow position, while the elastic massage ball 30*b* may be securely affixed to the rigid axle 30 so that it resides in a spread apart position. The adjustability of the massage tool 100 may help users of the tool 100 to configure the massage balls in a manner that provides optimal positioning along the muscles of their back, when they use the message tool 100.

Figure 2:
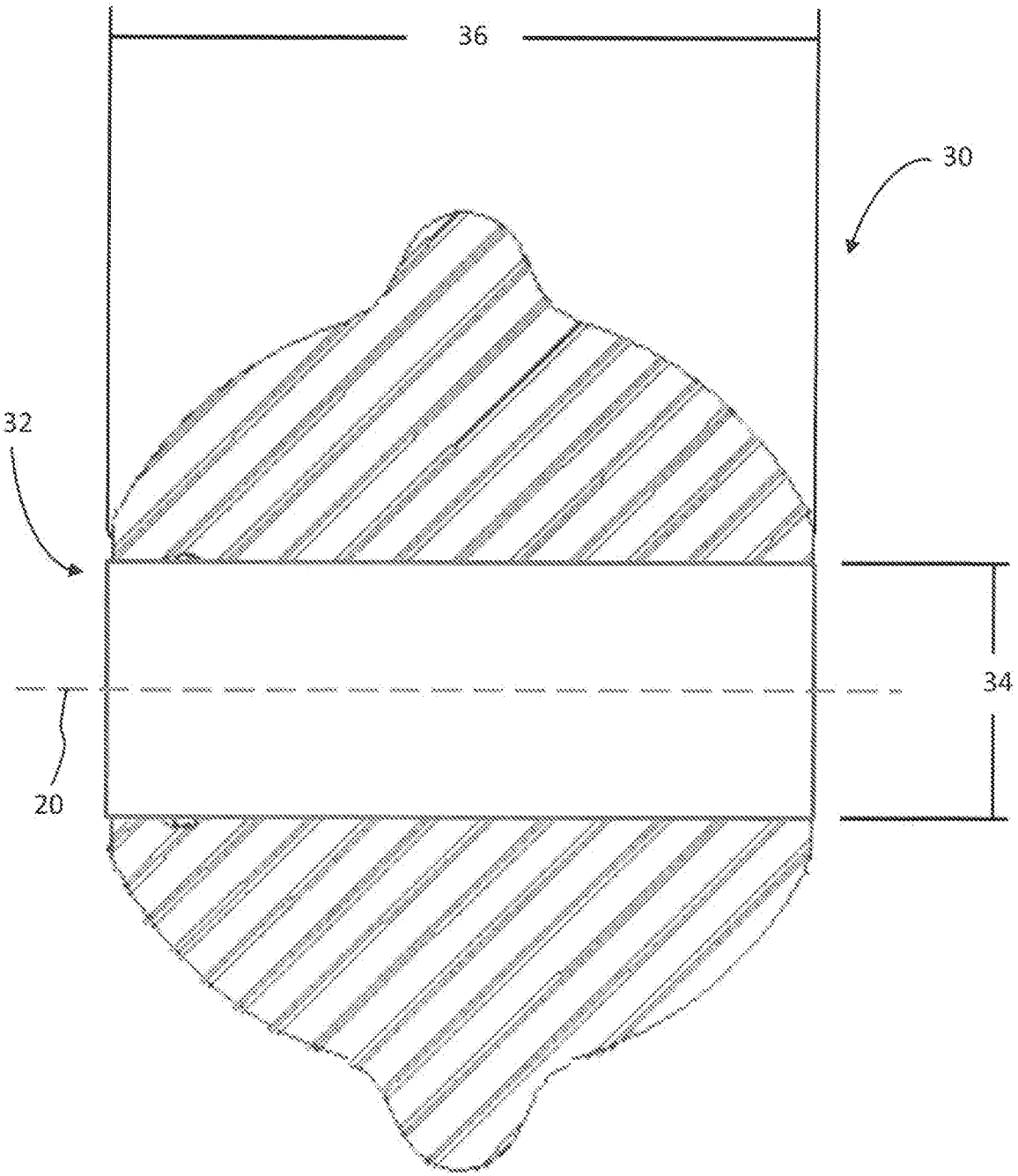
FIG. 2 depicts a side cross-section view of an embodiment of a massage ball.

With further reference to the drawings, FIG. 2 depicts a side cross-section view of an embodiment of a massage ball 30. The message ball 30 may be a singular element formed of an elastic material, such as rubber, synthetic rubber, thermoplastic elastomer, thermoplastic polyurethane, high density foam, and/or other like materials. A message ball 30 having some elasticity may afford a degree of comfort and provide more efficient muscular massagability, because the message ball 30 may give and flex, or have portions that give and flex, and comply somewhat to the muscular shape of a user of the massage tool 100, as the massage tool 100 is used to massage the user. Each embodiment of a massage ball 30, such as massage balls 30*a* and 30*b*, may include a center bore 32. The center bore 32 of a massage ball 30 may extend along a central axis 35. In addition, the center bore 32 may have a fixed center bore diameter 34 and a bore length 36. While the center bore 32 may have a consistent bore diameter 34 extending throughout the bore length 36, the elasticity of the material comprising the massage ball 30 may allow portions of the wall of the bore to give and expand slightly, when sufficient force is exerted thereon. The center bore diameters 34 and bore lengths 35 of the center bores 32 of each massage ball 30, such as massage balls 30*a* and 30*b*, may be substantially equal in size to each other. That is, various embodiments of a message ball 30 may all have similarly-sized center bores 32 extending along similarly located central axis 5, so that the massage elements may be disposed on a rigid axle 20 to form an adjustable massage tool 100.

Figure 3A:
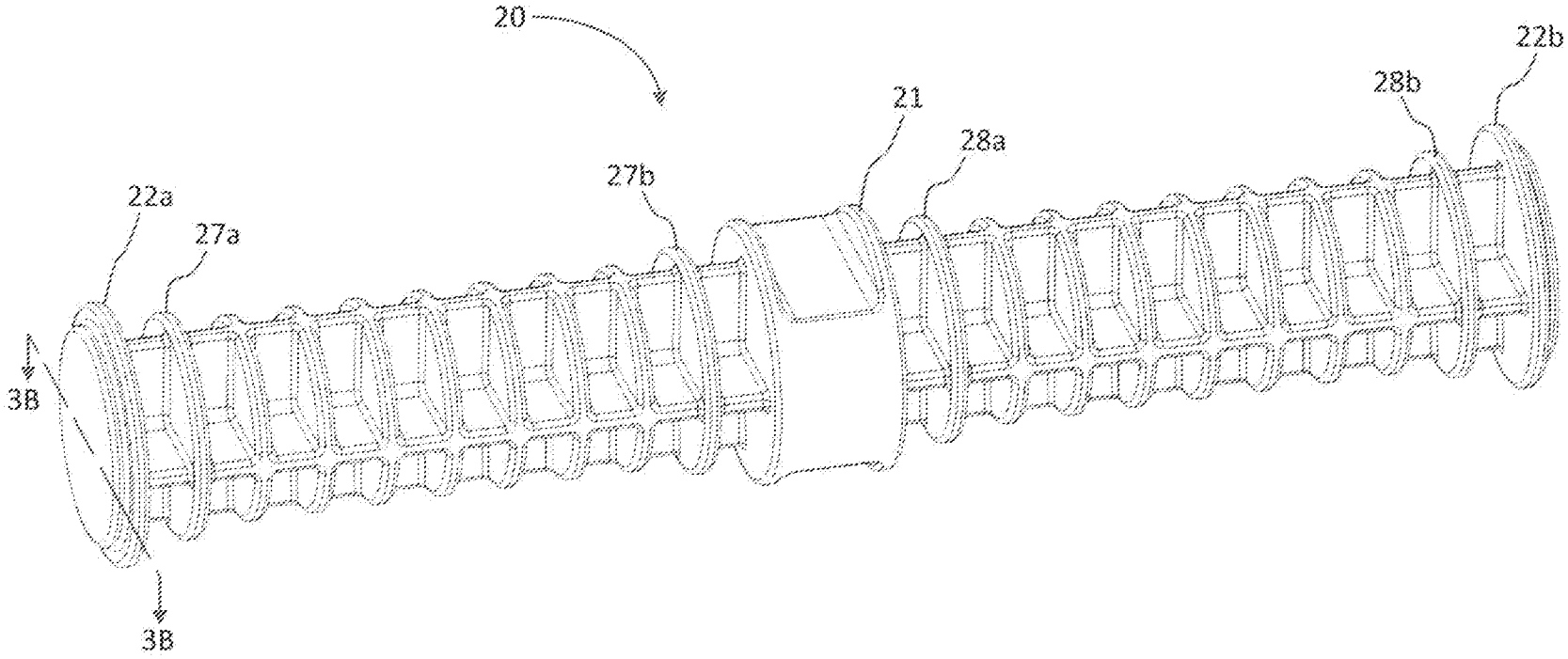
FIG. 3A depicts a perspective view of an embodiment of a rigid axle of an embodiment of an adjustable peanut massage tool.

Each massage ball 30 of an adjustable peanut massage tool 100 may be configured to movably, but securely, attach to and operate with a rigid axle 20. FIG. 3A depicts a perspective view of an embodiment of a rigid axle 20 of an embodiment of an adjustable peanut massage tool 100. A rigid axle 20 may be of one-piece construction or may be formed of several joined parts. Embodiments of a rigid axle may include an annular center stop 21 located proximate a center of the rigid axle 20. Moreover embodiments of a rigid axle 20 may include annular end stops 22, such as annular end stops 22*a* and 22*b*, on opposing ends of the rigid axle 20. In addition, embodiments of a rigid axle may include one or more sets of adjustment ridges, such as adjustment ridge set 27*a* and 27*b* and/or adjustment ridge set 28*a* and 29*b*. Each set of adjustment ridges may comprise and inner adjustment ridge, such as inner adjustment ridges 27*b* and 28*b*, and an outer adjustment ridge, such as outer adjustment ridges 27*a* and 28*a*. At least one set of adjustment ridges, such as adjustment ridge set 27*a* and 27*b*, may be located along the rigid axle 20 between the annular center stop 21 and a first annular end stop, such as annular end stop 22*a*. Where embodiments of an adjustable peanut massage tool 100 have adjustable functionality corresponding to both peanut massage elements, such as both massage balls 30*a* and 30*b*, a second set of adjustment ridges, such as adjustment ridge set 28*a* and 28*b*, may be located along the rigid axle between the annular center stop and a second annular end stop, such as annular end stop 22*b*, on an opposite end of the rigid axle 20 from the first annular end stop, such as annular end stop 22*a*. An inner positioning protrusion, such as annular ridge 27*b* and/or annular ridge 28*b*, may be located axially closer to the center stop protrusion 21 than an outer positioning protrusion, such as respectively corresponding annular ridges 27*a* and 28*a*.

Figure 3B:
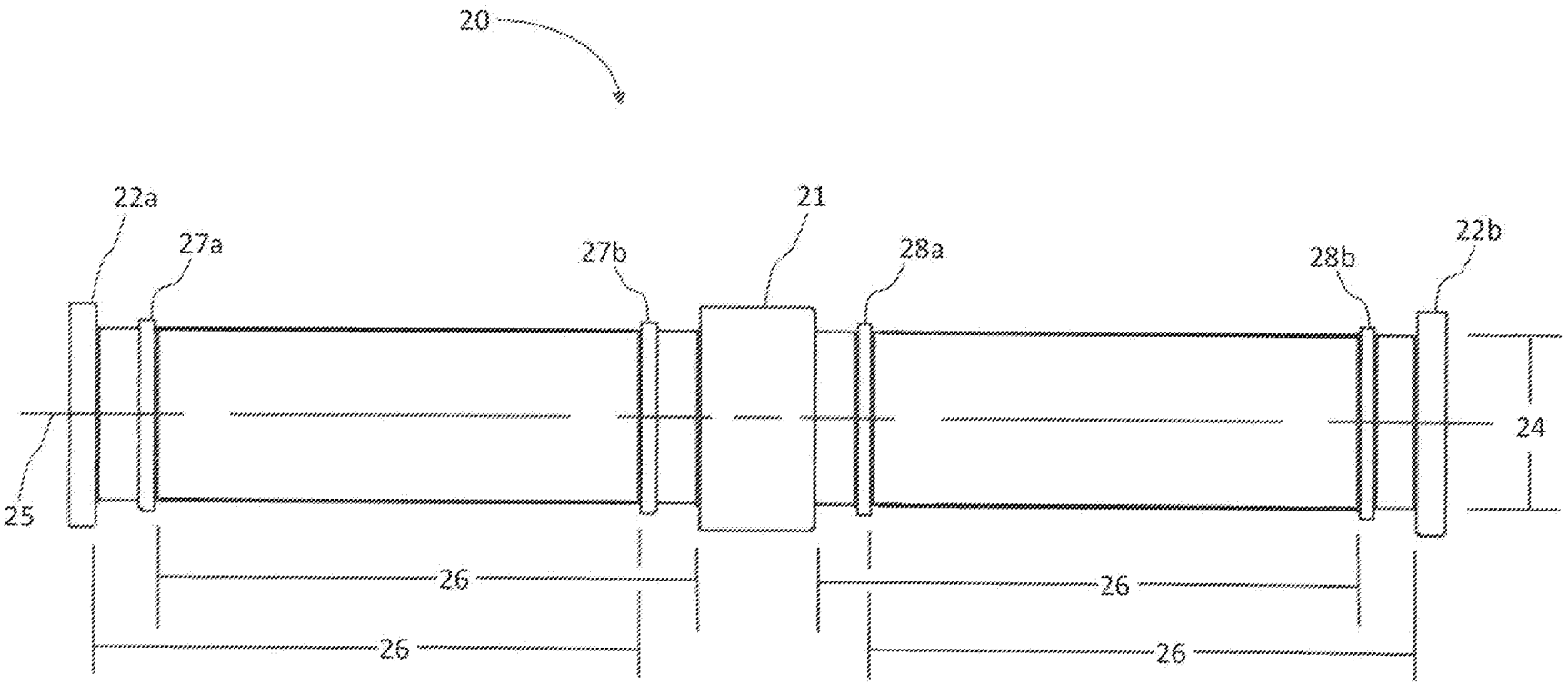
FIG. 3B depicts a side cut-away view of the embodiment of the rigid axle of FIG. 3A.

As further shown in FIG. 3B, which depicts a side cut-away view of the embodiment of the rigid axle of FIG. 3A, embodiments of the center stop 21, the end stops 22 and the positioning or adjustment ridges, such as ridges 27*a-b* and 28*a-b*, may comprise protrusions that extend from a root diameter 24 of the rigid axle 20. The root diameter 24 may be the base diameter of the majority of the lengthwise extension of the rigid axle 20. The root diameter 24 of the rigid axle 20 may be substantially equal in size to the fixed-diameters of the center bores 32 of the massage balls 30, so that the root diameter 24 of the rigid axle 20 fits closely against the center bore 32 of a massage ball 30 when the massage ball 30 is fitted onto or otherwise positioned on the rigid axle 20. The center stop 21, the end stops 22 and the positioning or adjustment ridges, such as ridges 27*a-b* and 28*a-b*, may comprise protrusions that are not entirely annular, but still define structures having a radial dimension larger than a corresponding radial dimension of the rood diameter 24. In that regard, the center stop 21 may have an outer diameter larger than the root diameter 24 of the rigid axle 20. Likewise, the end stops 22*a-b* may each have outer diameters that are larger than the root diameter 24 of the rigid axle 20. The center stop 21 and end stops 22*a-b* may have outer diameters of similar size. In addition, the center stop protrusion 21 and the end stop protrusions 22*a-b* may be annular protrusion features and the inner and outer positioning protrusions may be annular ridges, such as annular adjustment ridges 27*a-b* and/or 28*a-b*.

To help facilitate adjustability of the peanut massage elements, such as massage balls 30*a-b*, the inner and outer adjustment ridges, such as adjustment ridges 27*a-b* and/or 28*a-b*, may have outer diameters that are larger than the root diameter 24 but smaller than the outer diameters of the center stop 21 and the end stops 22*a-b* of the rigid axle 20. In this manner, the adjustment ridges may exist as positioning protrusions, which each protrude a distance from the root outer diameter 24 of the rigid axle 20 that is less than a distance that the center stop 21 and the end stops 22*a-b* protrude from the root outer diameter 24 of the rigid axle 20. Furthermore, the inner and outer positioning protrusions or adjustment ridges, such as adjustment ridges 27*a-b* and/or 28*a-b*, may be positioned along the rigid axle 20 so that an axial distance between the center stop 21 and either of the outer adjustment ridges is substantially equal to the bore length 36 of each elastic massage ball, such as message balls 30 and 30*b*. As such, the axial distance between either inner adjustment ridge, such as inner adjustment ridges 27*b* and 28*b*, and a nearest of the first or second annular end stop, such as end stops 22*a* and 22*b* respectively, is substantially equal to an axial distance between the annular center stop 21 and either of the outer adjustment ridges, such as outer adjustment ridges 27*a* and 28*a*. Moreover, a length 36 of the center bore 32 of each massage ball 30 is substantially equal to an axial distance between the center stop protrusion 21 and the outer positioning protrusion, such as outer adjustment ridges 27*a* and 28*a*, and substantially equal to an axial distance between the inner positioning protrusion, such as adjustment ridges 27*b* and 28*b*, and a nearest one of the end stop protrusions, such as, respectively, annular end stops 22*a* and 22*b*.

Figure 4A:
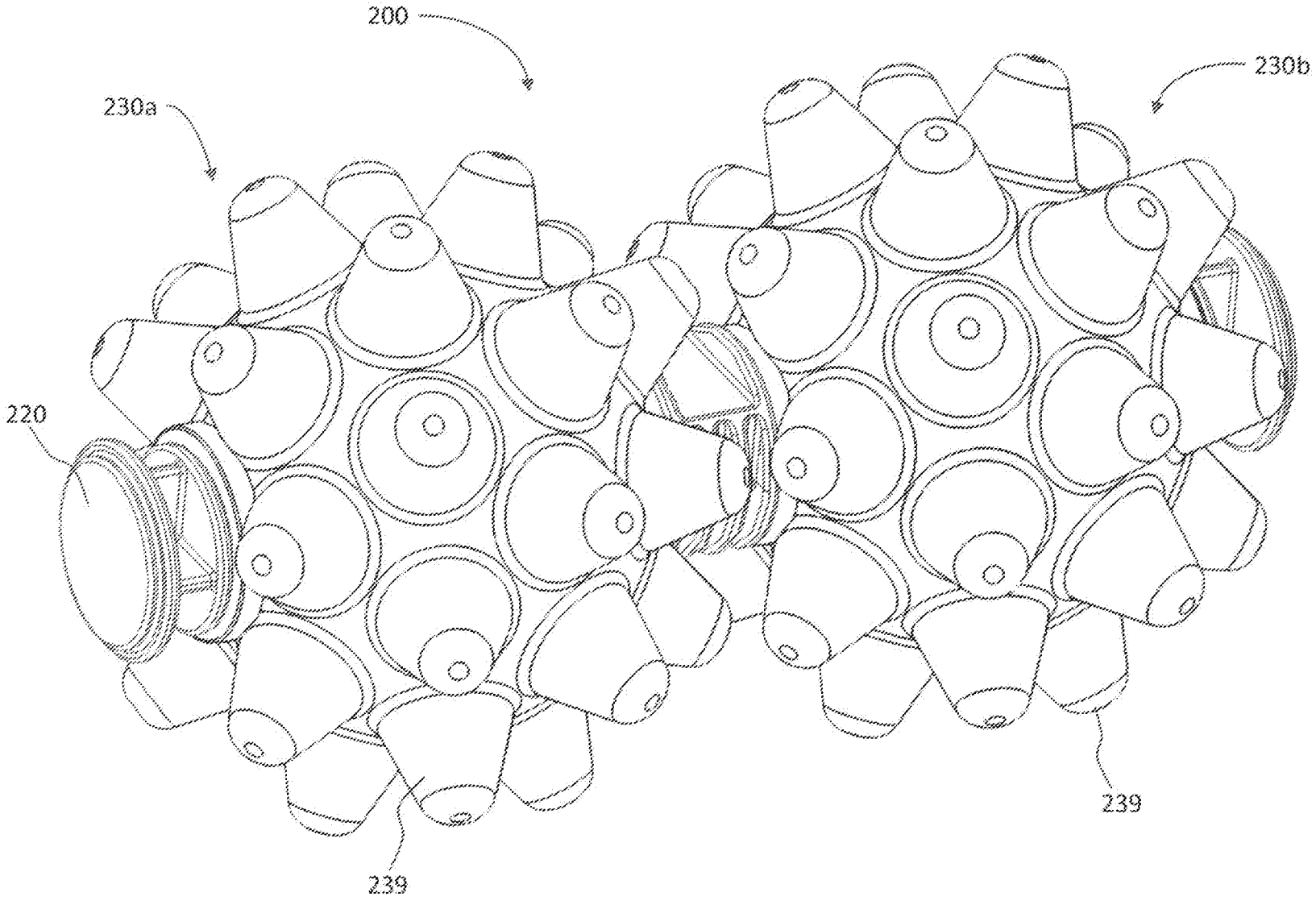
FIG. 4A depicts a side perspective view of an embodiment of an adjustable massage tool.

With continuing reference to the drawings, FIG. 4A depicts a side perspective view of an embodiment of an adjustable massage tool 200. Like a massage tool 100, a massage tool 200 may include a rigid axle 220 upon which two massage elements, such as massage balls 230*a* and 230*b*, are securely, yet axially adjustably, affixed. At least one of the massage elements, such as massage balls 230*a* and 230*b*, may include a plurality of protrusions 239. The protrusions 239 may be sized, shaped and positioned upon the massage ball, such as massage ball 230*a* and/or massage ball 239, in a manner that may facilitate more effective massaging. In addition, the protrusions 239 may be elastic, so that they flex and compress when pressed against a user's muscles during massaging, which elasticity may further facilitate comfortable and effective massaging functionality.

Figure 4B:
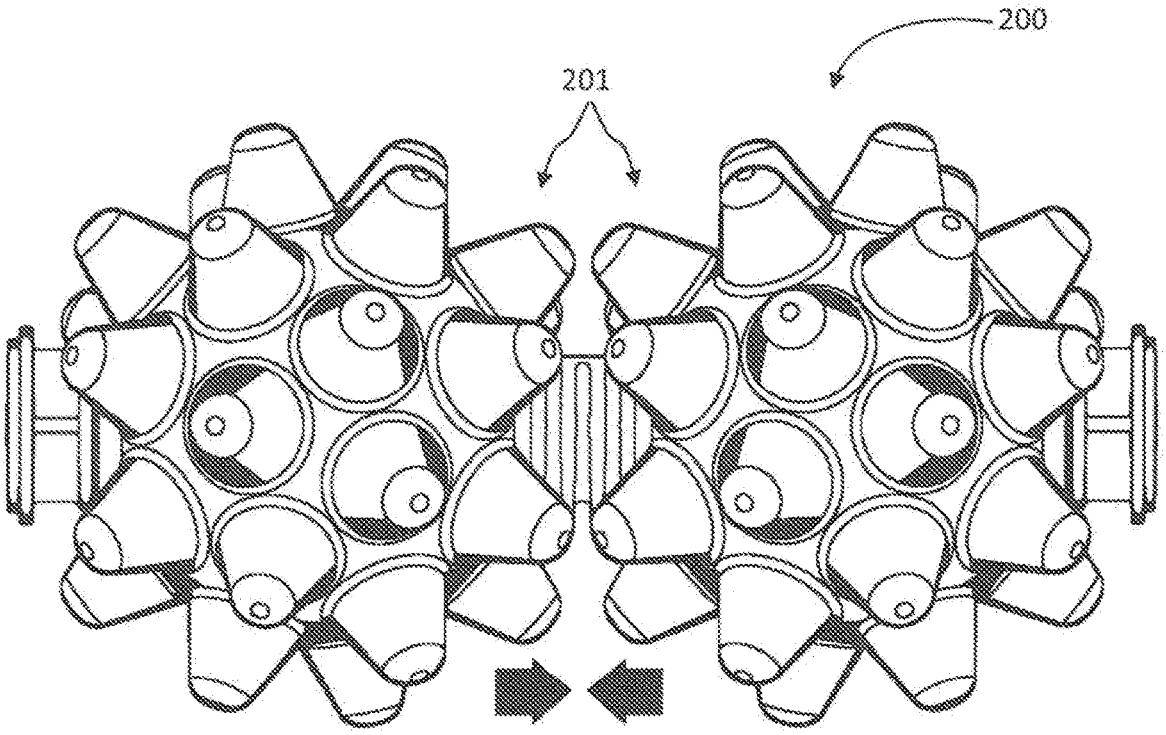
FIG. 4B depicts a side view of the adjustable massage tool of FIG. 4A, wherein the tool is in a first narrow configuration.
Figure 4C:
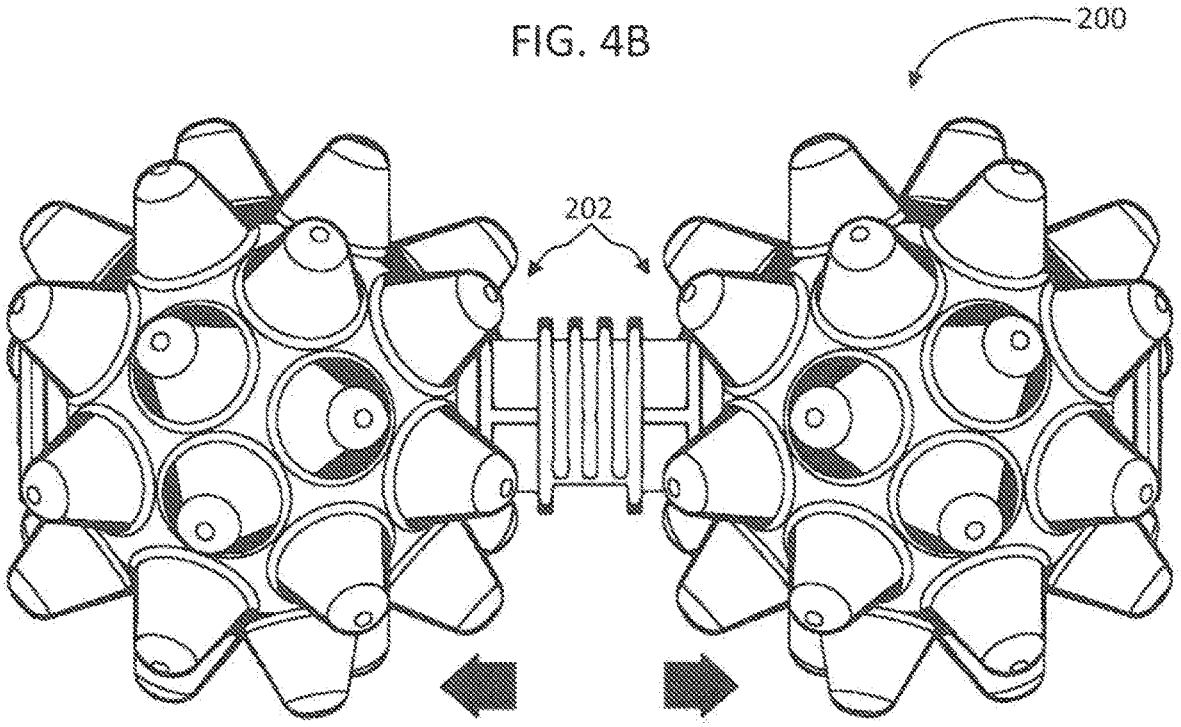
FIG. 4C depicts a side view of the adjustable massage tool of FIG. 4A, wherein the tool is in a second spread apart configuration.

In a manner similar to massage tool 100, the massage balls 230*a* and 230*b* of massage ball 200 may be maneuvered to various positions along the rigid axle 200. For example, FIG. 4B depicts the massage tool 200, wherein the massage balls 230*a* and 230*b* are in a first narrow configuration. FIG. 4C depicts the massage tool 200, wherein the massage balls 230*a* and 230*b* are in a second spread apart configuration. Arrows (used only for illustrative purposes in regards to the depictions of FIGS. 4B and 4C) emphasize the positioning movement of the massage balls 230*a* and 230*b*, when the massage tool 200 resides in a first narrow configuration 201 and/or a second spread apart configuration 202.

Figure 5:
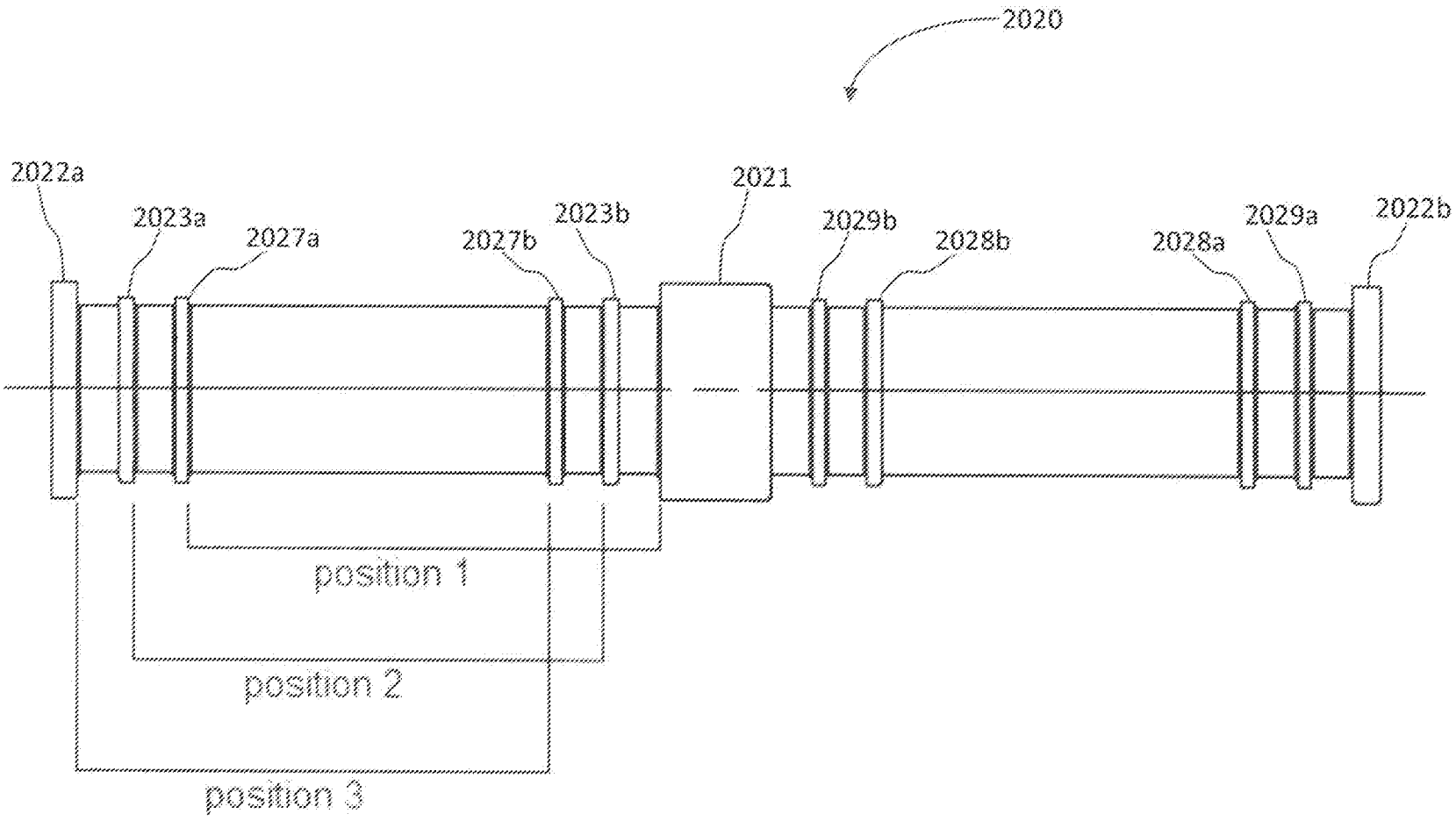
FIG. 5 depicts a side view of another embodiment of a rigid axle of an embodiment of an adjustable peanut massage tool.

Embodiments such as a massage tool 100 and/or a massage tool 200, or other like embodiments, may include a rigid axle having additional sets of positioning protrusions. For example, FIG. 5 depicts a side view of an embodiment of a rigid axle 2020 of an embodiment of an adjustable peanut massage tool, such as massage tool 100 or massage tool 200. The rigid axle 2020 may include two additional sets of inner and outer adjustment ridges, wherein a third set, such as adjustment ridges 2023*a* and 2023*b*, of the two additional sets of adjustment ridges is located along the rigid axle 2020 between the annular center stop 2021 and the first annular end stop 2022*a*, and a fourth set, such as adjustment ridges 2029*a* and 2029*b*, of the two additional sets of adjustment ridges is located along the rigid axle 2020 between the annular center stop 2021 and the second annular end stop 2022*b*. Furthermore, an axial distance between the inner and outer adjustment ridges of each of the two additional sets of adjustment ridges, such as adjustment ridges 2023*a* and 2023*b* and/or adjustment ridges 2029*a* and 2029*b*, is substantially equal to the bore lengths 36 of the fixed-diameter center bores 32 of each of the two elastic massage balls, such as massage balls 30*a* and 30*b*.

Figure 6:
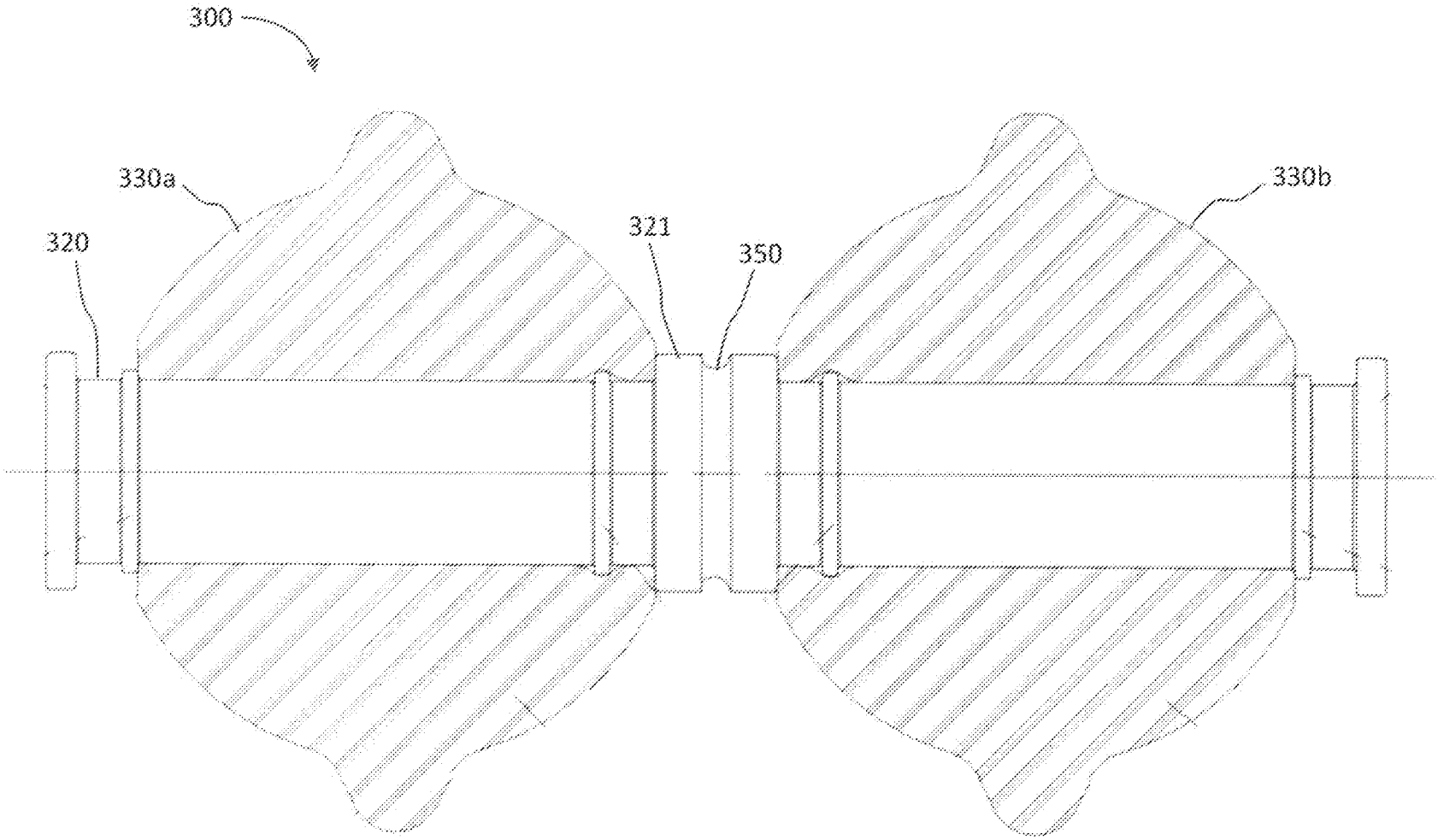
FIG. 6 depicts a side cross-section view of another embodiment of an adjustable massage tool.
Figure 7:
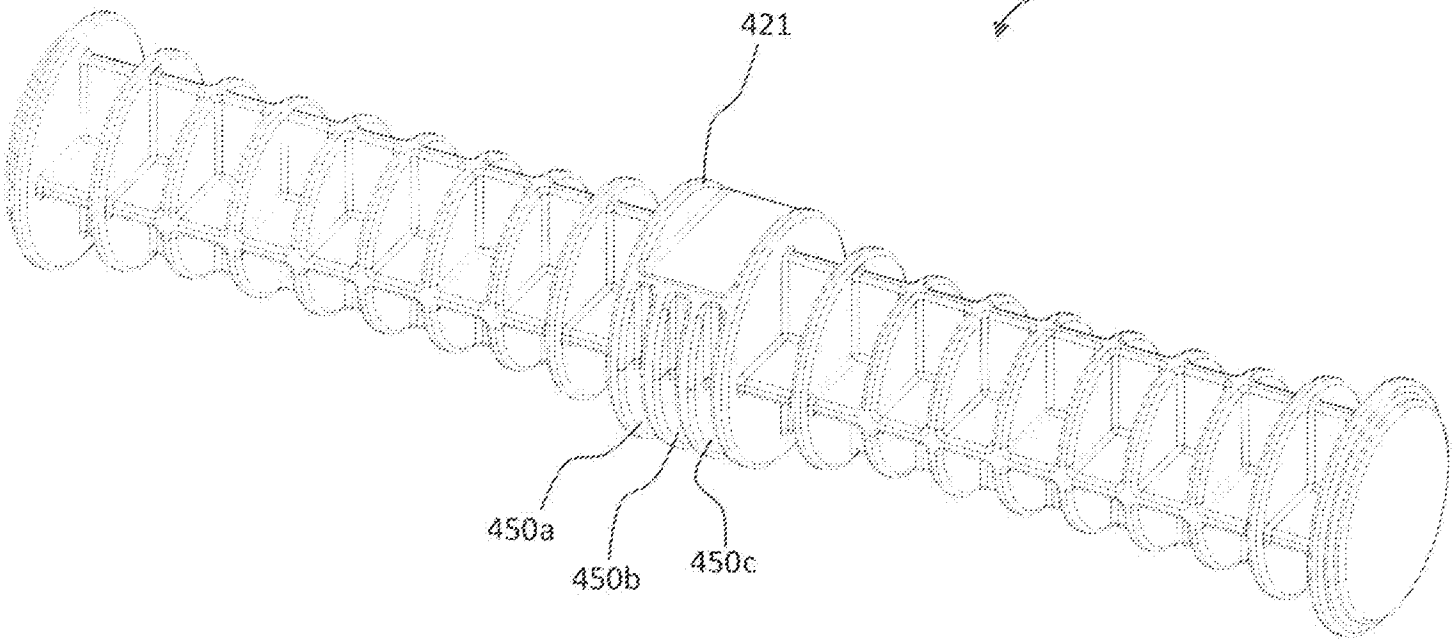
FIG. 7 depicts a side perspective view of another embodiment of a rigid axle of an embodiment of an adjustable peanut massage tool.

Turning still further to the drawings, FIG. 6 depicts a side cross-section view of another embodiment of an adjustable massage tool 300. The axle 320 of an adjustable massage tool 300 may include a center stop 321 having at least one indention 350. The at least one indention 350 may correspond to a balance point of the adjustable massage tool 300. A user of the adjustable massage tool may be able to fasten a rope or other harness into and around the indention 350, so that the adjustable massage tool 300 may be hung in a balanced position, as suspended by the rope or harness engaged with the indention 350. In this manner, the peanut lobes comprised by the massage balls, such as massage balls 330*a* and 330*b* may remain fairly horizontal with respect to one another. When a rope or harness is engaged with the indention 350, the axle 320 may still spin or otherwise rotate. Thus, a user may string a rope around the indention and suspend the massage tool 300 in a manner such at it may rolled along the user's back when balanced and suspended against a wall or a door. The indention 350, may, therefore, provide a user with the ability to utilize the device to effectuate a massage while standing up against a door or wall.

Because the peanut lobe massage elements, such as massage balls 30*a-b*, 230*a-b*, 330*a-b* and other like massage balls, may be securely adjusted into various positions along the axle, it may be advantageous to provide an axle 420 having a plurality of indentions 450*a-c* located proximate the central stop 421 of the axle 420. Each indention, such as indentions 450*a*, 450*b* and 450*c*, of the plurality of indentions may correspond to a balance point of the adjustable massage tool associatively depending on the adjusted placement of the two elastic massage balls, such as massage balls 30*a-b*, 230*a-b*, 330*a-b*, along the rigid axle 420 and the relative mass of the massage balls.

Methodology may be provided to adjustably secure massage balls to a massage tool, such as a peanut massager. With regard to FIGS. 1-7, a peanut massager, such as massage tools 100, 200 and 300, and other like peanut massagers may be provided. The peanut massager may include an axle, such as axles 20, 220, 320, 420 and 2020, and other like axles having a root outer diameter, a center stop protrusion, end stop protrusions located at opposing ends of the axle, and at least one set of positioning protrusions located between the center stop protrusion and at least one of the end stop protrusions. Moreover, an inner positioning protrusion of the at least one set of positioning protrusions of the axle may be located axially closer to the center stop protrusion than an outer positioning protrusion of the at least one set of positioning protrusions. In addition, the outer and inner positioning protrusions may each protrude from the root outer diameter of the axle a distance that is less than a distance that the center stop protrusion and the end stop protrusions protrude from the root outer diameter of the axle. The peanut massager may further include two massage elements, such as massage balls 30*a-b*, 230*a-b*, 330*a-b*, wherein each massage element contains a center bore having a bore diameter substantially equal to the root outer diameter of the axle. The length of the center bore of each massage ball may be substantially equal to an axial distance between the center stop protrusion and the outer positioning protrusion of the axle, and/or substantially equal to an axial distance between the inner positioning protrusion and a nearest one of the end stop protrusions of the axle.

Additional methodology for adjustably secure massage balls to a massage tool, such as a peanut massager, may include maneuvering the two massage elements, such as massage balls 30*a-b*, 230*a-b*, 330*a-b*, so that the center bore of each massage element passes over at least one of the end stop protrusions of the axle and also so that the center bore of at least one of the two massage elements additionally passes over at least one of the positioning protrusions of the axle, thereby allowing the massage elements to be adjustably yet securely located at a designated position along the axle. The center boar of at least one of the two massage elements, such as massage balls 30*a-b*, 230*a-b*, 330*a-b*, may pass over at least two of the adjustment protrusions, such as annular adjustment ridges, of the axle. Moreover, maneuvering the two massage elements may comprise maneuvering at least a first of the two massage elements so that its center bore passes over a first end stop protrusion of the axle, and maneuvering at least a second of the two massage elements so that its center bore passes over the other end stop protrusion, so that the massage balls are located on each side of the center stop protrusion of the axle. Still further, each of the massage elements may be maneuvered so their center bores both pass over a first of the end stop protrusions, and one of the two massage elements is further maneuvered so that its center bore additionally passes over the center stop protrusion, so that the massage elements are located on opposing sides of the center stop protrusion. As described previously, embodiments of an axle, such as axle 2020, may include one or more additional sets of positioning protrusions located on either side of the center stop protrusion. In such a case, methodology may include maneuvering operations wherein the center bore of each of the massage elements passes over at least one additional positioning protrusion of the at least one additional set of positioning protrusions of the axle, such as axle 2020.

Where the above examples, embodiments and implementations reference examples, it should be understood by those of ordinary skill in the art that massage tools, methodology and examples could be intermixed or substituted with those provided as virtually any components consistent with the intended operation of a method, system, or implementation may be utilized. Accordingly, for example, although particular component examples may be disclosed, such components may be comprised of any shape, size, style, type, model, version, class, grade, measurement, concentration, material, weight, quantity, and/or the like consistent with the intended purpose, method and/or system of implementation.

In places where the description above refers to particular embodiments of a massage tool, it should be readily apparent that a number of modifications may be made without departing from the spirit thereof. Accordingly, the disclosed subject matter is intended to embrace all such alterations, modifications, and variations that fall within the spirit and scope of the disclosure and the knowledge of one of ordinary skill in the art. The presently disclosed embodiments are, therefore, to be considered in all respects as illustrative and not restrictive.

What is claimed is:

1. An adjustable massage tool, comprising:

two elastic massage balls, wherein each of the two elastic massage balls include a center bore having a fixed center diameter with a bore length, wherein the center diameters of the center bores and the bore lengths of each massage ball are substantially equal in size to each other; and a rigid axle including:

a root outer diameter, wherein the root outer diameter is substantially equal in size to the fixed-diameters of the center bores of each of the two elastic massage balls;

an annular center stop located proximate a center of the rigid axle and having an outer diameter larger than the root diameter of the rigid axle;

annular end stops on opposing ends of the rigid axle, wherein outer diameters of each of the annular end stops are each larger than the root diameter of the rigid axle; and two sets of adjustment ridges, each set comprising an inner adjustment ridge and an outer adjustment ridge, wherein a first set of the two sets of adjustment ridges is located along the rigid axle between the annular center stop and a first annular end stop, and a second set of the two sets of adjustment ridges is located along the rigid axle between the annular center stop and a second annular end stop on an opposite end of the rigid axle from the first annular end stop;

wherein all the inner and outer adjustment ridges have outer diameters larger than the root diameter, but smaller than outer diameters of the annular center stop and the first and second annular end stops;

wherein the center bore of each massage ball is configured to expand over the adjustment ridges as the adjustment ridges pass through the center bore to allow each of the massage balls to adjust between a narrow configuration wherein each of the massage balls is adjacent a corresponding annular end stop of the annular end stops and a spread apart configuration wherein each of the massage balls is adjacent the annular center stop; and wherein the inner and outer adjustment ridges are positioned along the rigid axle so that an axial distance between the annular center stop and either of the outer adjustment ridges is substantially equal to the bore length of each of the two elastic massage balls, and the axial distance between either inner adjustment ridge and a nearest of the first or second annular end stop is substantially equal to an axial distance between the annular center stop and either of the outer adjustment ridges.

2. The adjustable massage tool of claim 1, wherein the rigid axle is of one-piece construction.

3. The adjustable massage tool of claim 1, wherein each of the two elastic massage balls include a plurality of elastic protrusions.

4. The adjustable massage tool of claim 1, wherein the two elastic massage balls are formed of material selected from the group consisting of:

rubber;

thermoplastic elastomers;

thermoplastic polyurethane; and high density foam.

5. The adjustable massage tool of claim 1, wherein the rigid axle further comprises two additional sets of inner and outer adjustment ridges, wherein a third set of the two additional sets of adjustment ridges is located along the rigid axle between the annular center stop and the first annular end stop, and a fourth set of the two additional sets of adjustment ridges is located along the rigid axle between the annular center stop and the second annular end stop, and further wherein an axial distance between the inner adjustment ridge and the outer adjustment ridge of each of the two additional sets of adjustment ridges is substantially equal to the bore lengths of the fixed-diameter center bores of each of the two elastic massage balls.

6. The adjustable massage tool of claim 1, wherein the annular center stop includes at least one indention, wherein the indention corresponds to a balance point of the adjustable massage tool.

7. The adjustable massage tool of claim 6, wherein the annular center stop further includes a plurality of indentions, wherein each indention of the plurality of indentions corresponds to a balance point of the adjustable massage tool depending on the adjusted placement of the two elastic massage balls along the rigid axle.

8. A massage tool, comprising:

an axle including a root outer diameter, a center stop protrusion, end stop protrusions located at opposing ends of the axle, and at least one set of positioning protrusions located between the center stop protrusion and at least one of the end stop protrusions, wherein an inner positioning protrusion of the at least one set of positioning protrusions is located axially closer to the center stop protrusion than an outer positioning protrusion of the at least one set of positioning protrusions, and further wherein the outer and inner positioning protrusions each protrude from the root outer diameter of the axle a distance that is less than a distance that the center stop protrusion and the end stop protrusions protrude from the root outer diameter of the axle; and two massage elements, wherein each massage element contains a center bore having a bore diameter substantially equal to the root outer diameter of the axle, and further wherein a length of the center bore of each massage element is substantially equal to an axial distance between the center stop protrusion and the outer positioning protrusion, and substantially equal to an axial distance between the inner positioning protrusion and a nearest one of the end stop protrusions;

wherein the center bore of each massage element is configured to expand over the positioning protrusions as the positioning protrusions pass through the center bore to allow each of the massage elements to adjust between a narrow configuration wherein each of the massage elements is adjacent a corresponding end stop protrusion of the end stop protrusions and a spread apart configuration wherein each of the massage elements is adjacent the center stop protrusion.

9. The massage tool of claim 8, wherein the two massage elements are each massage balls made of an elastic material.

10. The massage tool of claim 8, wherein the axle is rigid.

11. The massage tool of claim 10, wherein the rigid axle is of one-piece construction.

12. The massage tool of claim 8, wherein the center stop protrusion includes at least one indention located at a balance point of the massage tool.

13. The massage tool of claim 12, wherein the center stop protrusion includes a plurality of indentions correspondingly located at balance points of the tool associatively depending on the location of the massage elements along the axle and the relative mass of the massage elements.

14. The massage tool of claim 8, wherein the center stop protrusion and the end stop protrusions are annular protrusion features and the inner and outer positioning protrusions are annular ridges.

15. A method of adjustably securing massage elements to a peanut massager, the method comprising:

providing a peanut massager including:

an axle including a root outer diameter, a center stop protrusion, end stop protrusions located at opposing ends of the axle, and at least one set of positioning protrusions located between the center stop protrusion and at least one of the end stop protrusions, wherein an inner positioning protrusion of the at least one set of positioning protrusions is located axially closer to the center stop protrusion than an outer positioning protrusion of the at least one set of positioning protrusions, and further wherein the outer and inner positioning protrusions each protrude from the root outer diameter of the axle a distance that is less than a distance that the center stop protrusion and the end stop protrusions protrude from the root outer diameter of the axle; and two massage elements, wherein each massage element contains a center bore having a bore diameter substantially equal to the root outer diameter of the axle, and further wherein a length of the center bore of each massage element is substantially equal to an axial distance between the center stop protrusion and the outer positioning protrusion, and substantially equal to an axial distance between the inner positioning protrusion and a nearest one of the end stop protrusions;

wherein the center bore of each massage element is configured to expand over the positioning protrusions as the positioning protrusions pass through the center bore to allow each of the massage elements to adjust between a narrow configuration wherein each of the massage elements is adjacent a corresponding end stop protrusion of the end stop protrusions and a spread apart configuration wherein each of the massage elements is adjacent the center stop protrusion; and maneuvering the two massage elements so that the center bore of each massage element expands and passes over at least one of the end stop protrusions and so that the center bore of at least one of the two massage elements additionally expands and passes over at least one of the positioning protrusions of the axle, thereby allowing the massage elements to be adjustably yet securely located at a designated position along the axle.

16. The method of claim 15, wherein the center bore of at least one of the two massage elements expands and passes over at least two of the adjustment protrusions.

17. The method of claim 15, wherein maneuvering the two massage elements comprises maneuvering at least a first of the two massage elements so that its center bore expands and passes over a first end stop protrusion of the axle, and maneuvering at least a second of the two massage elements so that its center bore expands and passes over the other end stop protrusion, so that the massage elements are located on each side of the center stop protrusion.

18. The method of claim 15, wherein each of the massage elements are maneuvered so their center bores both expand and pass over a first of the end stop protrusions, and one of the two massage elements is further maneuvered so that its center bore additionally expands and passes over the center stop protrusion, so that the massage elements are located on opposing sides of the center stop protrusion.

19. The method of claim 15, wherein the axle further includes at least one additional set of positioning protrusions located on either side of the center stop protrusion.

20. The method of claim 19, wherein the center bore of each of the massage elements expands and passes over at least one additional positioning protrusion of the at least one additional set of positioning protrusions.

* * * * *